US006237266B1

(12) United States Patent
Tassey et al.

(10) Patent No.: US 6,237,266 B1
(45) Date of Patent: May 29, 2001

(54) EVACUATION ROUTE HAVING PHOTOLUMINESCENT INDICATORS

(76) Inventors: Daniel J. Tassey, 70 Crigger Rd.; Kenneth F. Newbold, 95 Crigger Rd., both of Wantage, NJ (US) 07461

( * ) Notice: Subject to any disclaimer, the term of this patent is extended or adjusted under 35 U.S.C. 154(b) by 0 days.

(21) Appl. No.: 08/890,688

(22) Filed: Jul. 11, 1997

(51) Int. Cl.[7] ..... G09F 13/20

(52) U.S. Cl. ..... 40/542; 428/89; 362/84; 362/153

(58) Field of Search ..... 40/542; 362/84, 362/153; 250/462.1; 116/202, 205, DIG. 17; 428/89

(56) References Cited

U.S. PATENT DOCUMENTS

| | | | | |
|---|---|---|---|---|
| 2,169,657 | * | 8/1939 | Millson . | |
| 2,347,285 | * | 4/1944 | Russell | 40/542 |
| 2,382,355 | * | 8/1945 | Warren, Jr. | 250/462.1 |
| 2,838,762 | * | 6/1958 | Wadely . | |
| 2,910,792 | | 11/1959 | Pfaff, Jr. . | |
| 3,408,025 | * | 10/1968 | Davis . | |
| 3,738,299 | | 6/1973 | Packler et al. . | |
| 3,996,556 | | 12/1976 | Eigenmann . | |
| 4,148,023 | | 4/1979 | Elkin . | |
| 4,245,282 | | 1/1981 | Sokol | 362/84 |
| 4,336,289 | * | 6/1982 | Davis | 428/89 X |
| 4,347,499 | * | 8/1982 | Burkman, Sr. et al. . | |
| 4,360,557 | * | 11/1982 | Miller | 250/462.1 X |
| 4,385,586 | * | 5/1983 | Schriever | 116/205 |
| 4,401,050 | | 8/1983 | Britt et al. | 116/205 |
| 4,422,069 | | 12/1983 | Edström et al. . | |
| 4,489,308 | | 12/1984 | Logan, Jr. et al. . | |
| 4,737,764 | | 4/1988 | Harrison | 362/153 X |
| 4,754,372 | | 6/1988 | Harrison | 362/32 |
| 4,794,373 | | 12/1988 | Harrison | 362/153 X |
| 4,801,928 | * | 1/1989 | Minter . | |
| 5,027,741 | * | 7/1991 | Smith et al. | 116/205 |
| 5,130,909 | | 7/1992 | Gross | 362/153 |
| 5,270,100 | | 12/1993 | Giglio | 40/542 X |
| 5,331,918 | * | 7/1994 | Honigsbaum | 116/DIG. 17 X |
| 5,362,544 | * | 11/1994 | Reuben | 428/89 X |
| 5,412,544 | | 5/1995 | Derrick et al. | 362/84 |
| 5,605,734 | * | 2/1997 | Yeh | 428/89 X |
| 5,607,222 | | 3/1997 | Woog | 362/84 |
| 5,674,437 | * | 10/1997 | Geisel . | |
| 5,698,301 | * | 12/1997 | Yonetani | 40/542 X |
| 5,714,255 | * | 2/1998 | Yeh | 428/89 X |
| 5,724,909 | * | 3/1998 | Pitman | 40/542 X |
| 5,904,017 | * | 5/1999 | Glatz et al. . | |
| 5,961,072 | * | 10/1999 | Bodle | 40/542 X |

OTHER PUBLICATIONS

Brochure entitled "Johnsonite's Revolutionary 21st Century Flooring Systems", Johnsonite, Div. of Duramax, Inc., 1996, pp. 1–6.

Brochure entitled "Flooring Solutions to Integrate Design and Life–Safety", Johnsonite, Div. of Duramax, Inc., 1996, pp. 1 and 12–13.

"Guidelines to Safety . . . ", LongLite Product Brochure, date unknown but prior to Jul. 11, 1996, pp. 1–8.

* cited by examiner

*Primary Examiner*—Joanne Silbermann
(74) *Attorney, Agent, or Firm*—Lerner, David, Littenberg, Krumholz & Mentlik, LLP

(57) ABSTRACT

An evacuation route indicator includes a carpeted strip extending in an elongation direction and having direction-indicating indicia formed thereon at spaced intervals along the elongation direction. The indicia include a photoluminescent material and are formed so as to define a surface which is either recessed below or raised above the remaining surface of the carpeted strip, or a surface texture which is different from the surface texture of the remainder of the carpeted strip. Thus, the indicia are discernible both visually and tactilely in the absence of light. The indicator may also include a photoluminescent marker extending substantially continuously in the elongation direction on the carpeted strip.

2 Claims, 3 Drawing Sheets

EVACUATION ROUTE HAVING PHOTOLUMINESCENT INDICATORS

FIELD OF THE INVENTION

The present invention relates generally to building evacuation or exit route indicators, and, more particularly, to photoluminescent indicators for delineating an evacuation route to be followed by building occupants during reduced visibility conditions.

BACKGROUND OF THE INVENTION

Local building codes and fire ordinances generally require buildings to be equipped with "EXIT" signs which are intended to assist the occupants of a building to find their way to the building's exits during an emergency. In most instances, the EXIT signs are illuminated so that they will be visible to the building's occupants in the event there is a power failure, thick smoke, or other condition in the building which impairs visibility. These signs typically are mounted above the exits in order to be visible from the largest possible area. Self-powered emergency lighting may also be provided to enable the occupants to find their way to an exit.

Unfortunately, in the event of an emergency in which visibility is impaired, these illuminated EXIT signs cannot always be seen. For instance, in the event of a power failure, the building may be too dark for the occupants to make their way to the vicinity of an exit where the EXIT sign would be visible. Other emergency situations involve the presence of smoke which ordinarily rises toward the ceiling, thus obscuring the EXIT sign even when an occupant is in the immediate vicinity of an exit. Furthermore, the illuminated EXIT signs and emergency lighting may fail, leaving the occupants of the building in complete darkness as they search for an exit out from the building.

One approach for directing occupants of a building to an exit when there is little or no available light has involved the use of photoluminescent materials. Such materials have been incorporated in photoluminescent paints, polymer webs, signs and the like which have been placed in factories, laboratories and other buildings to direct the occupants of those buildings to the nearest exit in the event of an emergency. While such systems may be effective, they are unattractive and have therefore been unacceptable for use in office buildings, hotels and other buildings in which aesthetically pleasing surroundings are an important concern.

In order to meet the demand for a photoluminescent system which is not aesthetically objectionable, but which is effective in directing the occupants of a building to the nearest exit in the absence of light, a carpet has been developed which incorporates photoluminescent fibers as part of the carpet pile. These fibers may be incorporated in the carpet pile in the form of direction-identifying indicia which, in the absence of light, point the occupants of a building in a particular direction toward an exit.

The aforementioned carpeting system has largely been unsuccessful. One problem with the system is that the photoluminescent fibers, having been woven to the carpet backing so as to project substantially perpendicular therefrom, emit a perceptible glow only from the exposed ends of the fibers. As a result, the carpet system emits only a faint glow which is difficult to see in partial or complete darkness. Also, with the carpet installed on the floor, the photoluminescent fibers become dirty and worn from pedestrian traffic, further attenuating the glow emitted by the fibers. Furthermore, once the glow emitted by the fibers has faded so as to no longer be visually perceptible, the direction-indicating indicia are no longer useful for directing the occupants of the building to the exits.

there therefore exists the need for a system which will reliably direct the occupants of a building to the nearest exit. Preferably, the system will be effective in normal light conditions, as well as in the event of a power failure, thick smoke or other situation resulting in partial or complete darkness. Still more preferably, the system will not detract from the aesthetic appearance of a building's interior in the normal day-today operation of the building.

SUMMARY OF THE INVENTION

The present invention addresses these needs.

In accordance with one embodiment of the present invention, a system for indicating an exit path from a building consists of a strip of carpeting having a pair of opposed edges extending in an elongation direction and including a backing layer and a plurality of carpet fibers projecting from the backing layer. A plurality of direction-identifying indicia are formed on the strip of carpeting at spaced intervals along the elongation direction. Each indicia includes a photoluminescent surface at a first distance from the backing layer, with the plurality of carpet fibers surrounding the indicia and defining a carpet surface at a distance from the backing layer greater than the first distance. Preferably, the photoluminescent surface is formed from a photoluminescent filament embroidered into the strip of carpeting, and a light reflective layer is interposed between the backing layer and the photoluminescent surface.

The system preferably also includes a photoluminescent marker extending substantially continuously in the elongation direction on the strip of carpeting. The photoluminescent marker may be formed on one of the opposed edges of the strip of carpeting, and may include a photoluminescent surface and a light reflective layer interposed between the photoluminescent surface and the strip of carpeting. The photoluminescent surface may include a photoluminescent web or a serging formed from a photoluminescent filament attached to one of the opposed edges. The photoluminescent marker also may be formed on both of the opposed edges or between the opposed edges of the strip of carpeting.

In accordance with another embodiment of the present invention, a system for indicating an exit path from a building consists of a strip of carpeting having a pair of opposed edges extending in an elongation direction and including a backing layer and a plurality of carpet fibers connected to the backing layer. A plurality of direction-identifying indicia are formed on the strip of carpeting at spaced intervals along the elongation direction, each indicia being formed from a photoluminescent filament embroidered into the strip of carpeting. Preferably, a light reflective layer is interposed between the backing layer and the photoluminescent filament. More preferably, the system also includes a photoluminescent marker extending substantially continuously in the elongation direction on the strip of carpeting. The marker may consist of a photoluminescent surface and a light reflective layer interposed between the photoluminescent surface and the strip of carpeting.

In accordance with yet another embodiment hereof, a system for indicating an exit path from a building consists of a strip of carpeting having a pair of opposed edges extending in an elongation direction and including a backing layer and a plurality of carpet fibers connected to the backing layer. A plurality of direction-identifying apertures are formed in the strip of carpeting at spaced intervals along the elongation direction, and a photoluminescent material is juxtaposed with the strip of carpeting so as to be visible through the apertures. Preferably, the system also includes a photoluminescent marker extending substantially continuously in the elongation direction on the strip of carpeting.

In accordance with a still further embodiment of the present invention, a system for indicating an exit path from a building consists of a strip of carpeting having a pair of opposed edges extending in an elongation direction and including a backing layer and a plurality of carpet fibers projecting from the backing layer. A plurality of direction-identifying indicia are formed on the strip of carpeting at spaced intervals along the elongation direction, each indicia being formed from a photoluminescent material having a surface texture. The plurality of carpet fibers define a carpet surface surrounding the indicia, the carpet surface having a surface texture which is substantially different from the surface texture of the photoluminescent material. Again, the system preferably also includes a photoluminescent marker extending substantially continuously in the elongation direction on the strip of carpeting.

BRIEF DESCRIPTION OF THE DRAWINGS

A more complete appreciation of the subject matter of the present invention and the various advantages thereof can be realized by reference to the following detailed description in which reference is made to the accompanying drawings in which.

DETAILED DESCRIPTION OF THE PREFERRED EMBODIMENTS

Referring to the figures, FIGS. 2–5 illustrate preferred embodiments of an escape route indicator 10 in accordance with the present invention. Indicator 10 is formed from a strip of carpeting 12 including a backing layer 14 and a plurality of carpet fibers 16 joined to the backing layer and projecting therefrom to form the pile of the carpeting. Strip 12 may be formed from any conventional grade of carpeting, including grades having a relatively short loop pile, such as those used in office and retail spaces, and grades having a relatively long cut pile, such as those used in hotels. As used herein, the term "strip of carpeting" refers to an elongated web of carpeting having a width sufficient to incorporate direction-identifying indicia in accordance with the present invention, and includes a relatively narrow, elongated portion formed separately or integrally with a layer of carpeting installed on the floor of a room or hallway, as well as a relatively narrow web of carpeting, typically about 1–12 inches in width, and preferably about 4 inches in width, installed as a finishing moulding against the base of the walls of a room or hallway.

Figure 2:
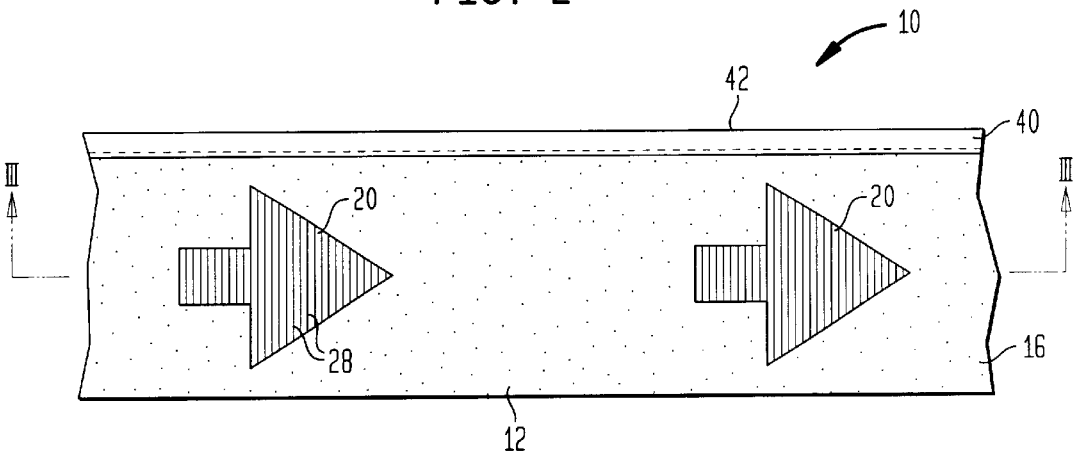
FIG. 2 is a plan view of an evacuation route indicator in accordance with one embodiment of the present invention.
Figure 5:
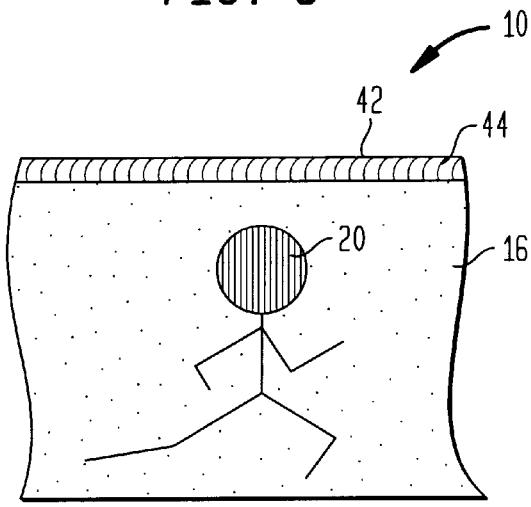
FIG. 5 is a plan view of an alternate embodiment of an evacuation route indicator in accordance with the present invention.

Indicator 10 includes a plurality of indicia 20 formed at spaced intervals along the length of strip 12. Indicia 20 may take any shape which is capable of indicating a single direction. For example, indicia 20 may take the form of an arrow as shown in FIG. 2. Alternatively, indicia 20 may be in the form of a running stick figure, as shown in FIG. 5, a pointing finger, a series of geometric shapes of increasing or decreasing size, one or more chevrons, or any other such symbol which is representative of direction. Preferably, indicia 20 are spaced so that a person adjacent a first indicia will be able to see the next indicia in the series, with an interval spacing of about four feet being preferred.

Indicia 20 preferably are formed on strip 12 so as to be discernible both visually and tactilely. That is, each indicia 20 preferably is formed on strip 12 so as to have a surface 22 which is either recessed below or raised above the surface 24 defined by carpet fibers 16, or a surface texture which is different from the texture of surface 24 defined by carpet fibers 16. In any one of these arrangements, each indicia 20 may be distinguished tactilely from the remaining portion of strip 12 merely by running one's fingers over the surface of the strip.

So that they may be visible in conditions of partial or complete darkness, indicia 20 desirably are formed from a material capable of emitting a glow without the use of a power source. Preferred materials in this regard are commercially available phosphorescent materials which have a faint yellow to green tint under normal light conditions, but which emit a yellow-green glow for a prolonged period of time in the absence of light.

Figure 3:
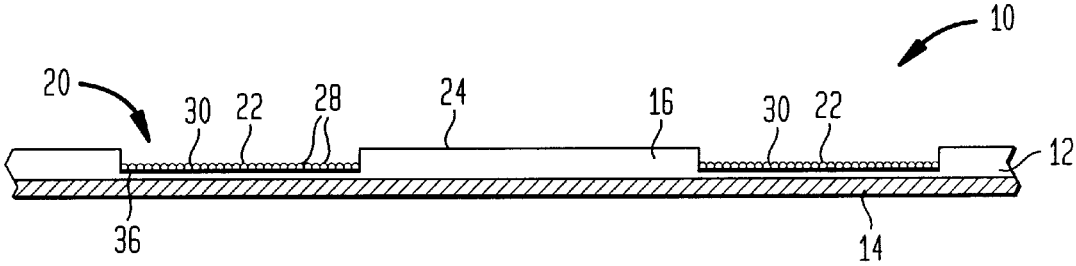
FIG. 3 is a cross-sectional view of the evacuation route indicator of FIG. 2 taken along line III—III thereof.
Figure 4:
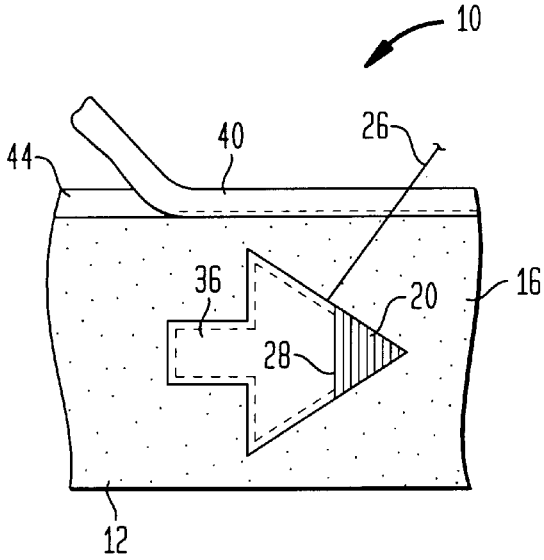
FIG. 4 is a highly schematic plan view showing a step in the construction of the evacuation route indicator of FIG. 2.

In a particularly preferred embodiment hereof, indicia 20 may be embroidered into strip 12 using a photoluminescent filament 26. One such filament is in the form of a yarn available from Longlite Technologies AG of Basel, Switzerland. The yarn may be used in its supplied form, or may be spun down to a thread prior to its use in the embroidery process. In either case, conventional processes and equipment for embroidering filaments onto relatively thick materials may be used to form indicia 20 on carpet strip 12. For example, the embroidery process may be performed using a Model No. AMS-20010 DHL or Model No. AMS-223 CGL embroidery machine available from Juki Corporation of Tokyo, Japan. In such embroidery processes, filament 26 is sewn over the surface 24 defined by the free ends of carpet fibers 16 and attached to backing layer 14 so as to form a series of side-by-side or partially overlapping filament segments 28 defining substantially continuous layers 30 of photoluminescent material in the profile shapes of indicia 20. When filament segments 28 are attached to the backing layer 14 of a strip 12 having relatively long carpet fibers 16, as illustrated in FIG. 3, segments 28 compress the carpet fibers thereunder so that layers 30 are formed with upper surfaces 22 which are recessed below surface 24. On the other hand, as filament segments 28 are attached to the backing layer 14 of a strip 12 having relatively short carpet fibers 16 which do not readily compress, segments 28 form layers 30 with surfaces 22 which are raised above surface 24 by about the thickness of filament 26.

In order to decrease the amount of the emitted light absorbed by strip 12 and thus increase the overall intensity of the glow emitted from indicia 20, strip 12 desirably includes a layer 36 of light-reflective material positioned below each photoluminescent layer 30. Layer 36 may be formed from a white or other lightly colored fabric or polymer web, a MYLAR polyester film, a metallic foil or any other light-reflective material. A swatch of such light-reflective material in the shape of indicia 20 may be sewn or otherwise held in the appropriate positions on strip 12, with filament 26 then embroidered thereover to form indicia 20. Alternatively, a white, lightly colored, metallic or other light-reflective filament may first be embroidered onto strip 12 to form a substantially continuous layer 36, with photoluminescent filament 26 subsequently embroidered thereover to form the indicia.

Indicia 20 formed in accordance with the above-described embroidery process are discernible both visually and tactilely in the absence of light. That is, a person feeling along the exposed surface of strip 12 would immediately be able to identify indicia 20 by virtue of having surfaces 22 recessed below or raised above the surface 24 defined by carpet fibers 16. The size and shape of indicia 20 also may be discernible from the fact that filament segments 28 provide surfaces 22 with a texture which is substantially different from the texture of surface 24. Furthermore, owing to the large surface area of filament 26 which is exposed as a result of the embroidery process and the use of a light-reflective layer 36 beneath layer 30, indicia 20 emit a strong, readily perceptible glow for a prolonged period of time. In fact, after exposure to normal room lighting for about three minutes, indicia 20 formed from the foregoing process typically will emit a glow for a period of about eight hours in the absence of light.

Indicator 10 may also include a photoluminescent marker 40 extending along the length of strip 12. Marker 40 may be positioned between the longitudinal edges of the strip, either to one side of indicia 20 or through the indicia interconnecting same. Preferably, however, marker 40 forms a continuous band along one longitudinal edge of the strip. In this regard, marker 40 may be formed using any technique that will produce this result. For example, marker 40 may be formed from a web of photoluminescent material wrapped over edge 42 and sewn or otherwise held in place as in a conventional carpet binding. Webs used for this purpose may include photoluminescent fabrics, thin sheets of photoluminescent polymers and the like. Alternatively, marker 40 may be formed by sewing a photoluminescent filament, such as filament 26, in a series of side-by-side loops to form a serging 44 along edge 42, as shown in FIG. 5. Marker 40 also may be formed by embroidering a continuous band along the length of strip 12, either along edge 42 or spaced therefrom. Other techniques for forming marker 40 include embroidering a band along the length of strip 12 using a photoluminescent filament, applying a ribbon of a photoluminescent fabric, paint, tape, etc. to the carpeted face of strip 12, etc. As with indicia 20, a layer 44 of a light-reflective material preferably is attached to strip 12 beneath marker 40 so as to decrease light absorption and thus increase the intensity of the glow emitted by the marker.

Indicators 10 preferably are mounted close to the floor of rooms and hallways in a building so as to enable building occupants to see or feel indicia 20 even under thick smoke conditions. In one arrangement illustrated in FIG. 1, indicators 10 may be installed as a finishing moulding against the base of the walls of a room or hallway. In such arrangement, indicators 10 would replace the carpeted or vinyl strips which are ordinarily used as a finishing moulding in carpet installations. Such installations would have little impact on the aesthetic appearance of the room or hallway and, indeed, the color of carpet fibers 16 and the patterns of indicia 20 may be selected to provide a particularly desirable decorative effect. Also, as a finishing moulding against the base of walls, indicators 10 would not be subjected to pedestrian traffic and the dirt and wear resulting therefrom.

With indicators 10 installed against the base of walls, markers 40 form a substantially continuous queueing line along each wall at a predetermined distance from the floor. Under reduced lighting conditions, the glow emitted by markers 40 will attract the occupants of the building toward the wall, even in the regions between indicia 20 or when the glow emitted by indicia 20 otherwise is not immediately seen. Hence, markers 40 help to orient the building's occupants and guide them to and then along the wall toward an exit.

Figure 1:
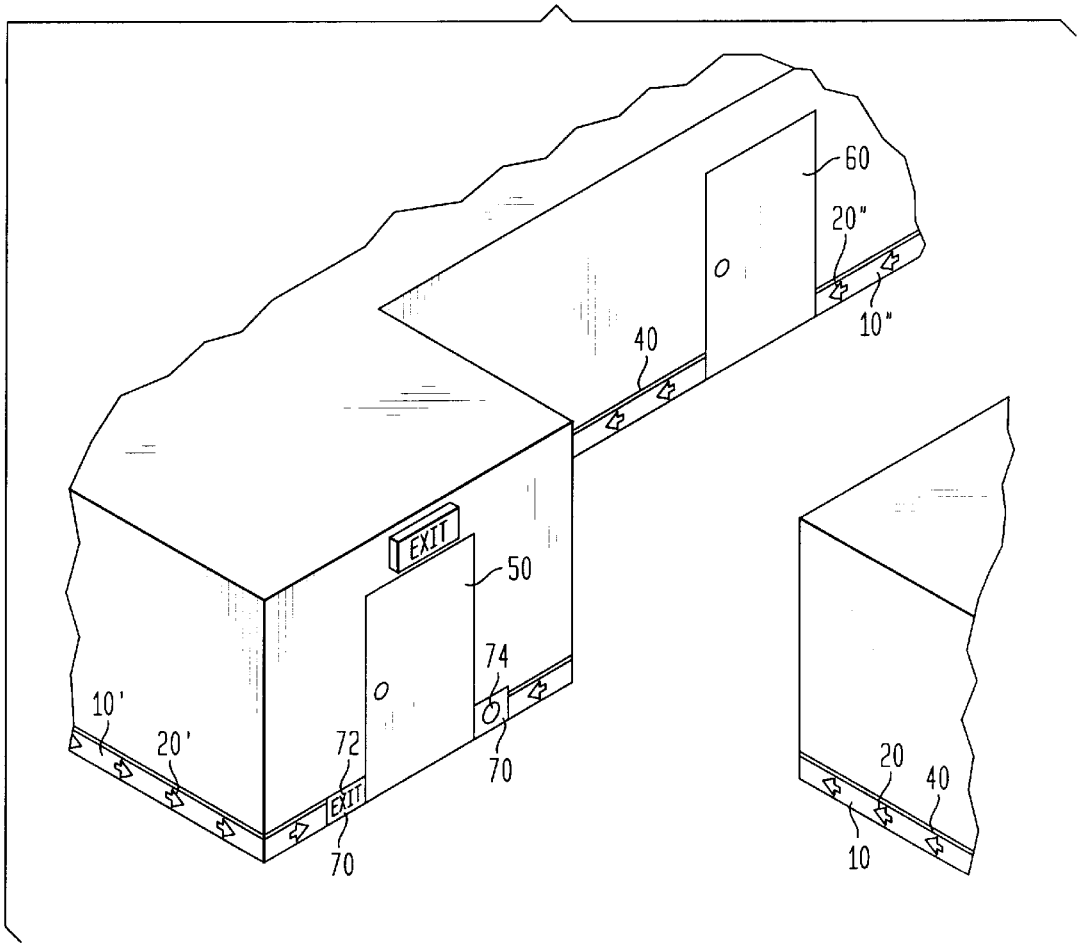
FIG. 1 is a schematic view of an emergency evacuation route indicating system in accordance with the present invention.

Referring to FIG. 1, indicators 10 may be installed so that indicia 20 direct the occupants of a building from any location in the building to the nearest exit. Thus, the indicia 20' on indicators 10' installed to the left of an exit door 50 may point toward the right to direct occupants in that vicinity toward the exit, while the indicia 20" on indicators 10" installed to the right of exit door 50 may point to the left to direct occupants in that vicinity toward the exit. When following indicia 20 to an exit, occupants may encounter doors which are exits from a room, such as exit door 50, or doors which merely lead to another room, such as door 60. One way to determine whether the door is an exit is to see or feel the indicia 20 on each side of the door. If the indicia point in the same direction, the door is not an exit. Rather, the indicia are directing the occupant past that door toward an exit. On the other hand, if the indicia on opposite sides of the door point in opposite directions, both toward the door, then that door is an exit.

Alternatively, a sign or other marker 70 may be placed on each side of a door, adjacent the floor, to identify that door as an exit. In one arrangement, sign 70 may include an indicia 72 in the form of a letter, such as the letter as "X", or a word, such as the word "EXIT", indicating that an exit door has been reached. In another arrangement, sign 70 may include a symbol 74 indicating that an exit has been reached. Indicia 72 and 74 preferably are formed from a photoluminescent material so as to be visible in the absence of light. More preferably, indicia 72 and 74 may be formed so as to be tactilely discernible from the remainder of sign 70, either by being recessed below or raised above the remainder of the surface of sign 70, or by having a texture which is different from that of the remainder of the sign. In a highly preferred embodiment, sign 70 may be formed from a short strip of carpeting of the same grade and color as strip 12 so as to blend inconspicuously with indicators 10 under normal lighting conditions. In such embodiment, indicia 72 and 74 may be formed using the same embroidery process as described above in connection with the formation of indicia 20 in carpet strip 12.

Indicia 20 may be formed using techniques other than the embroidery process described above. For example, strip 12 may be formed or trimmed so that the carpet fibers 16 within the area of indicia 20 are raised above or recessed below the surface 24 defined by the carpet fibers in the remainder of the strip. A layer 30 of a photoluminescent material may then be attached to or formed on the carpet fibers within the area of indicia 20, such as by applying a photoluminescent paint, or securing a photoluminescent tape, fabric, polymer sheet material or the like thereto. Here again, a layer 36 of a light reflective material preferably is interposed beneath layer 30.

Figure 6:
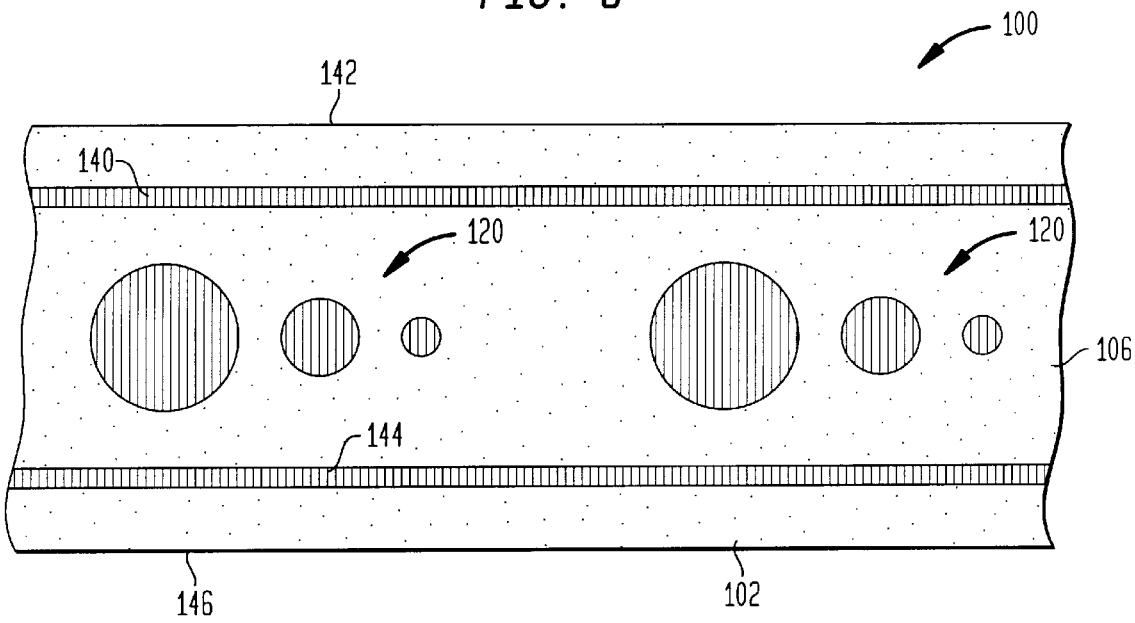
FIG. 6 is a plan view of yet another embodiment of an evacuation route indicator in accordance with the present invention.

An escape route indicator 100 in accordance with an alternate embodiment of the present invention is shown in FIG. 6. Indicator 100 is similar in construction to indicator 10 described above, but is particularly designed for installation as a feature strip in the carpeting on the floor of a room or hallway. Hence, indicator 100 may be formed from a strip of carpeting 102 including a backing layer (not shown) and a plurality of carpet fibers 106 connected to the backing layer and projecting therefrom to form the pile of the carpeting. A plurality of direction-identifying indicia 120 are formed at spaced intervals along the length of strip 102. As illustrated in FIG. 6, each indicia 120 is in the form of a series of three circles aligned side-by-side along the longitudinal axis of strip 102, the first circle being larger than the middle circle which, in turn, is larger than the third circle. Thus, a person will be directed in the proper direction by following the direction from the larger circle in an indicia 120 to the smallest circle therein. Indicia 120 may be constructed in any of the manners described above in connection with indicia 20.

Indicator 100 may also include one or more photoluminescent queueing markers, such as queueing markers 140 and 144, extending along the length of strip 102. Markers 140 and 144 may be formed by any of the techniques described above in connection with the formation of marker 40. Thus, markers 140 and 144 may be formed as a binding, serging, embroidered band or the like along the opposed longitudinal edges 142 and 146 of strip 102. In the preferred construction illustrated in FIG. 6, markers 140 and 144 are formed by embroidering a photoluminescent fiber along the length of strip 102 inwardly of edges 142 and 146, resulting in markers which are both visually and tactilely discernible in the absence of light. Moreover, this construction provides a margin of carpet pile along edges 142 and 146 which makes it easier to blend indicators 100 with the floor carpeting on either side thereof.

Indicator 100 may be installed as a feature strip in the carpeting on the floor of a room or hallway. This feature strip may extend as a border along the walls of the room or hallway or anywhere in the floor where it will be not only decorative, but readily visible so as to serve its function of guiding occupants out from a building. Indicator 100 may be installed using techniques conventional in the carpet industry. Thus, indicator 100 may be spliced together with the carpeting covering the major portion of the floor to form one or more feature strips down the middle of a hallway, a decorative border against the walls of a room or hallway, or an insert in any other location which will not detract from the aesthetics of its surroundings. In this regard, indicia 120 may be selected to provide a particularly desirable decorative effect, as well as for their direction-identifying capability.

Figure 7:
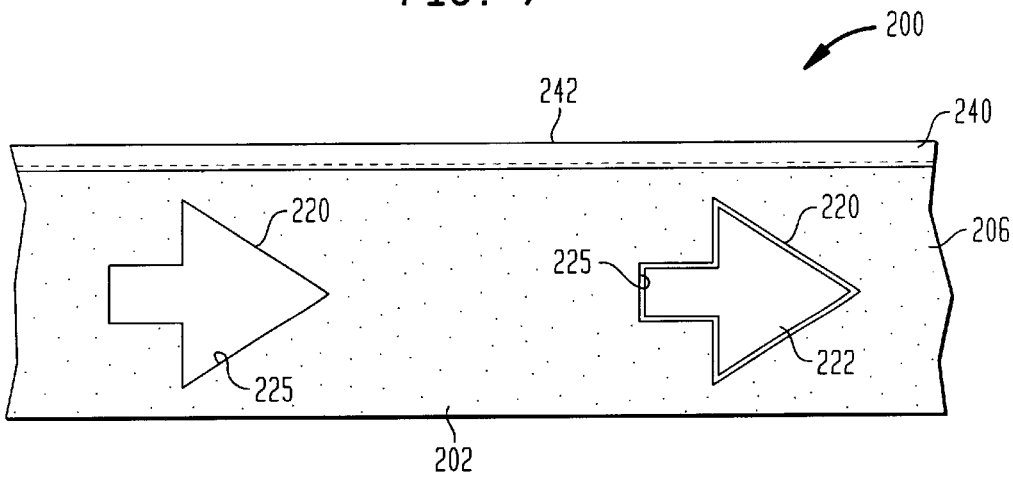
FIG. 7 is a plan view of a still further embodiment of an evacuation route indicator in accordance with the present invention.

A still further embodiment of an escape route indicator in accordance with the present invention is shown in FIG. 7. The indicator 200 illustrated in FIG. 7 is similar in construction to indicator 10 described above. Thus, indicator 200 may include a backing layer (not shown) and a plurality of carpet fibers 206 connected to the backing layer and projecting therefrom to form a strip of carpeting 202. However, rather than the embroidered indicia 20 described above, the indicia 220 of indicator 200 are defined by a plurality of direction-identifying apertures 225 diecut or otherwise formed at spaced intervals along the length of strip 202. Apertures 225 may take any of the shapes representative of direction as described above in connection with indicia 20. Indicator 200 may also include a substantially continuous photoluminescent marker 240 extending in the elongation direction of strip 202, and may be formed as a carpet binding or serging along edges 242 and/or 246, as a fabric, tape, polymer, painted or embroidered band along edges 242 and/or 246 or spaced inwardly therefrom, or by any other technique that provides a substantially continuous photoluminescent line along the length of the strip. Again, a light-reflective material (not shown) preferably is interposed beneath marker 240 to increase the intensity of the glow emitted by the marker.

Indicators 200 may be installed in a room or hallway in the same manner as indicators 10 or 100 described above. Prior to installing indicators 200, apertures 225 may be provided with a photoluminescent material which enables the shape of the apertures to be visible in the absence of light. This may be accomplished simply by painting the wall or floor behind indicators 200 with a photoluminescent paint such as is available from Longlite Technologies AG; by applying a photoluminescent fabric, polymer web, or tape behind apertures 225, either to the backing layer or to the wall or floor which is to support strip 202. In its installed position, indicator 200 would be discernible tactilely by feeling the outline of apertures 225 in strip 202, and would be discernible visually in the absence of light as a result of the photoluminescent material visible through the apertures.

In a variant of the foregoing embodiment, the indicia 220 for indicators 200 may consist of a photoluminescent insert

222 cut to shape and placed within apertures 225. Any number of methods may be used to form inserts 222. For example, inserts 222 may be formed by embroidering a photoluminescent filament to a fabric, such as the material forming the backing layer of strip 202, so as to form an embroidered patch having a thickness which is less than the thickness of strip 202. The patch may be inserted in aperture 225 directly, or a spacer may first be inserted so as to raise the exposed surface of the patch to the desired height above, below or contiguous with the surface of carpet fibers 206. Alternatively, indicators 222 may be formed from a block of a material, including wood, plastic, foam, gypsum board, etc., cut to the desired shape and to a thickness which is either greater than, less than or substantially the same as the thickness of strip 202, with one surface of the block coated with a photoluminescent sheet material, fabric, tape, paint, etc. Indicia 220 in accordance with this variant thus would also be discernible both tactilely and visually in conditions of little or no light.

Although the invention herein has been described with reference to particular embodiments, it is to be understood that these embodiments are merely illustrative of the principles and applications of the present invention. It is therefore to be understood that numerous modifications may be made to the illustrative embodiments and that other arrangements may be devised without departing from the spirit and scope of the present invention as set forth in the appended claims.

We claim:

1. A system for indicating an exit path from a building, comprising a strip of carpeting having a pair of opposed edges extending in an elongation direction and including a backing layer and a plurality of a carpet fibers projecting from said backing layer;

a photoluminescent marker extending substantially continuously in said elongation direction on said strip of carpeting, said photoluminescent marker including a photoluminescent surface and a light reflective layer interposed between said photoluminescent surface and said strip of carpeting, said photoluminescent surface including a serging formed on one of said opposed edges from a photoluminescent filament; and a plurality of direction-identifying indicia formed on said strip of carpeting at spaced intervals along said elongation direction, each said indicia including a photoluminescent surface at a first distance from said backing layer, said plurality of carpet fibers surrounding said indicia and defining a carpet surface at a distance from said backing layer greater than said first distance.

2. The system as claimed in claim 1, further comprising a light reflective layer interposed between said backing layer and said photoluminescent surface.

* * * * *